US006769588B2

(12) United States Patent
Zheng

(10) Patent No.: US 6,769,588 B2
(45) Date of Patent: Aug. 3, 2004

(54) CARRYING CASES HAVING AMUSEMENT FEATURES

(76) Inventor: Yu Zheng, 3825 N. Lemon Ave., #189, Walnut, CA (US) 91789-2344

( * ) Notice: Subject to any disclaimer, the term of this patent is extended or adjusted under 35 U.S.C. 154(b) by 469 days.

(21) Appl. No.: 09/773,113

(22) Filed: Jan. 31, 2001

(65) Prior Publication Data

US 2002/0100777 A1 Aug. 1, 2002

(51) Int. Cl.[7] ..... A45F 4/00

(52) U.S. Cl. ..... 224/929; 224/930; 190/1; 190/111; 190/109; 190/115

(58) Field of Search ..... 190/102, 1, 111, 190/109, 115, 16; 224/575, 576, 430, 929, 930; 206/579, 315.1

(56) References Cited

U.S. PATENT DOCUMENTS 4,132,295 A * 1/1979 Hochfelsen ..... 190/102
4,874,340 A 10/1989 Smallwood
5,136,726 A 8/1992 Kellin et al.
5,205,447 A * 4/1993 Hambrick ..... 224/42.33
5,222,259 A 6/1993 Bristor
5,394,565 A 3/1995 Stewart et al.
5,409,152 A * 4/1995 Trevino ..... 224/576
5,530,626 A 6/1996 Norment
D374,771 S 10/1996 Guegan et al.
5,734,991 A 4/1998 Schmid
5,788,032 A * 8/1998 Krulik ..... 190/108
5,795,213 A 8/1998 Goodwin
5,819,998 A * 10/1998 Chehebar ..... 224/153
5,878,672 A 3/1999 Ostermann et al.
5,897,042 A * 4/1999 Sims ..... 224/576
D411,778 S 7/1999 Bear
5,938,096 A * 8/1999 Sauer et al. ..... 224/625
5,975,392 A 11/1999 Miller et al.
6,092,705 A 7/2000 Meritt
6,393,745 B1 * 5/2002 Miki ..... 40/586
6,568,576 B1 * 5/2003 Godshaw et al. ..... 224/647

* cited by examiner

*Primary Examiner*—Jessica Harrison
*Assistant Examiner*—Corbett B Coburn
(74) *Attorney, Agent, or Firm*—Raymond Sun

(57) ABSTRACT

A carrying case has a storage section that has at least one storage compartment for receiving articles. An amusement feature is provided with the carrying case. The amusement feature can be an electronic device, or a non-electronic device. The amusement feature can be provided on an outer surface of the carrying case, on an inner panel disposed inside the storage section, on a pouch attached to the storage section, or at any internal or external location of the carrying case.

4 Claims, 19 Drawing Sheets

CARRYING CASES HAVING AMUSEMENT FEATURES

BACKGROUND OF THE INVENTION

1. Field of the Invention

The present invention relates to carrying cases, including backpacks, knapsacks, schoolbags, travel bags, hand bags, duffel bags, waist packs, note book cases, gym bags, briefcases, tote bags, luggage, tool boxes, lunch boxes, ice chests and others. In particular, the present invention relates to carrying cases have amusement features incorporated therewith.

2. Description of the Prior Art

As used herein, the term "carrying case" is intended to include any container that can be carried by any child or adult, the container being used to hold or retain virtually any item or object. These carrying cases can include, but are not limited to, backpacks, knapsacks, schoolbags, travel bags, hand bags, duffel bags, waist packs, note book cases, gym bags, briefcases, tote bags, tool boxes, lunch boxes, ice chests and luggage.

Conventional carrying cases have become increasingly popular, and the uses for these carrying cases have significantly increased. Both children and adults have found new and interesting uses for carrying cases, and manufacturers have often even modified specific types of carrying cases specifically for use by children. For example, portable luggage items, such as tote bags or carry-on bags with wheels, have been provided in smaller sizes, in striking colors, and with animated depictions of cartoon characters sewed thereon, for use by children. Unfortunately, most of these conventional carrying cases only serve a single purpose, which is to store items and objects. Most of these conventional carrying cases do not provide much, if any, amusement to the user.

SUMMARY OF THE DISCLOSURE

It is an object of the present invention to provide a carrying case which has an amusement associated therewith.

It is another object of the present invention to provide a carrying case having an amusement that includes electronic games and devices.

It is yet another object of the present invention to provide a carrying case that can be used for additional purposes other than to carry items and objects.

The present invention provides a carrying case having a storage section that has at least one storage compartment for receiving articles. An amusement feature is provided with the carrying case. The amusement feature can be an electronic device, or a non-electronic device. The amusement feature can be provided on an outer surface of the carrying case, on an inner panel disposed inside the storage section, on a pouch attached to the storage section, or at any internal or external location of the carrying case.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
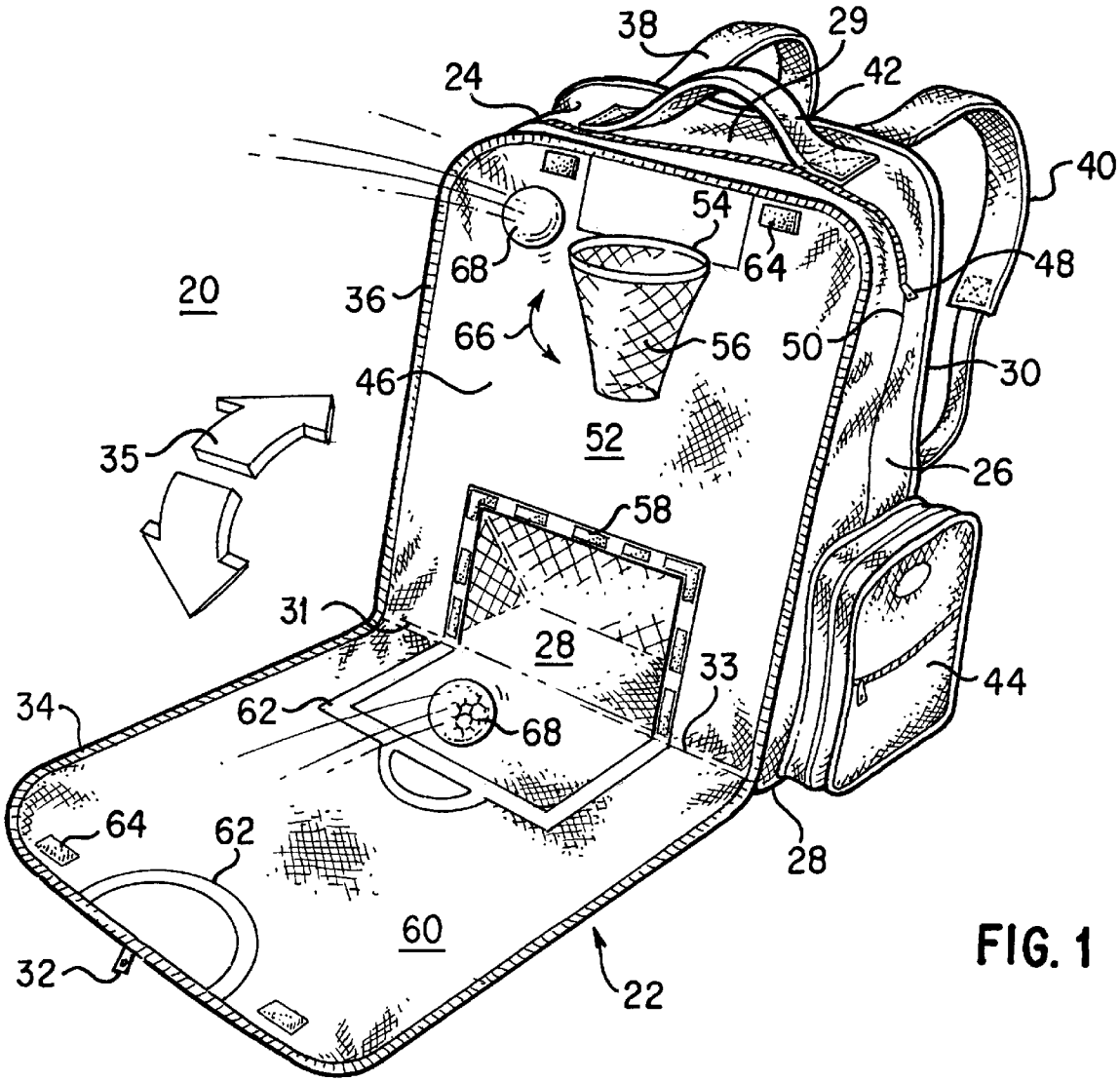
FIG. 1 is a perspective view of a carrying case according to one embodiment of the present invention shown with its front panel opened.

Referring to FIG. 1, one embodiment of the present invention is a knapsack 20 that can have amusement features incorporated therewith. The knapsack 20 enables hand-free carrying of books, lunch boxes, and other items, and is constructed of a front panel 22, side panels 24 and 26, a bottom panel 28, a top panel 29, and a rear panel 30 interconnected with each other, such as by stitching, to form an enclosed storage space. The front panel 22 and the rear panel 30 are substantially flat (i.e., planar) and have a generally rectangular shape to provide the knapsack with a generally rectangular appearance. The front panel 22 can be attached along peripheral edges thereof to opposed side panels 24, 26 and the top panel 29 by a zipper 32 having at least one zipper tab interacting with two intermeshing tracks, a first track 34 on the peripheral edges of the front panel 22, and a second track 36 extending along the side panels 24, 26 and the top panel 29. The side panels 24, 26 and the top panel 29 can be designed to completely overlie the zipper 32 to obscure the zipper 32. The front panel 22 can be pivoted about its bottom edge 31 and the bottom edge 33 of the bottom panel 28, as shown by the arrows 35. Each of the panels 22, 24, 26, 28, 29, 30 (including inner panel 46 described below) can be made from any fabric material (e.g., nylon, cloth, hard cotton), vinyl or leather.

A pair of adjustable straps 38, 40 are attached at ends thereof (e.g., by stitching) to spaced-apart locations along the rear panel 30. Each strap 38, 40 can s include conventional adjustment mechanisms, such as an adjustment buckle, which allows for adjustment of the amount of space between the straps 38, 40 and the rear panel 30 to fit the wearer of the knapsack 20. In addition, a handle 42 can be secured to the top panel 29 to allow the knapsack 20 be lifted and carried by hand. A storage pouch 44 can also be stitched to the side panel 26 to function as a side pocket for retaining certain smaller items (e.g., keys).

Although the above-described type and arrangement of panels 22, 24, 26, 28, 29, 30, zipper 32, straps 38, 40, handle 42, and pouch 44 are illustrated in FIG. 1, these elements are standard in the manufacture of knapsacks, and those skilled in the art will appreciate that many different constructions, arrangements and elements can be provided for the carrying case of the present invention.

The knapsack 20 further includes an inner panel 46 that can be coupled to the side panels 24, 26 and the top panel 29. For example, the inner panel 46 can be attached along peripheral edges thereof to the side panels 24, 26 and the top panel 29 by stitching. Another zipper 48 having at least one zipper tab interacting with two intermeshing tracks 50 can be provided along the side panels 24, 26 and the top panel 29 to provide access to a first enclosed space that is defined by the side panels 24, 26, the bottom panel 28, the top panel 29, the rear panel 30, and the inner panel 46. A second enclosed space is defined by the front panel 22, the side panels 24, 26, the bottom panel 28, the top panel 29, and the inner panel 46. Thus, the inner panel 46 can act as a divider for dividing the enclosed storage space into the first and second enclosed spaces. The inner panel 46 can assume the same shape as the front panel 22 and the rear panel 30.

The surface 52 of the inner panel 46 that faces the front panel 22 can be provided with an amusement feature, such as a circular hoop 54 having a net 56 of interwoven material strips. The hoop 54 can be pivotably secured to the inner panel 46 using any known or conventional means, including but not limited to the use of mounting brackets (as illustrated in U.S. Pat. No. 5,819,998, whose disclosure is incorporated by this reference as though fully set forth herein), straps and stitching, or other mechanisms known in the art. The hoop 54 can be pivoted about the arrow 66 from the position shown in FIG. 1 (where the hoop 54 is generally perpendicular to the inner panel 46) to a position where the hoop 54 is generally parallel to, and collapsed against, the inner panel 46.

In addition, a rectangular opening 58 can be cut from the bottom of the inner panel 46 and used as a soccer or hockey-type goal. The inner surface 60 of the front panel 22 can be provided with indicia 62 for marking a soccer or other field. It is also possible to provide removable or releasable attachment mechanisms (e.g., opposing VELCRO™ straps 64) on the facing surfaces 52 and 60 of the inner panel 46 and the front panel 22, respectively, to allow the panels 22 and 46 to be closed.

As a result, the knapsack 20 can be used by the user as a ball toss game in addition to its normal usage as a storage bag. The user can unzip the zipper 32 to open the front panel 22, exposing the hoop 54 and soccer goal 58, so that the user can take a ball 68 (which can be stored in the knapsack 20) and either toss it at the hoop 54, or roll or kick the ball 68 at the goal 58.

Figure 2:
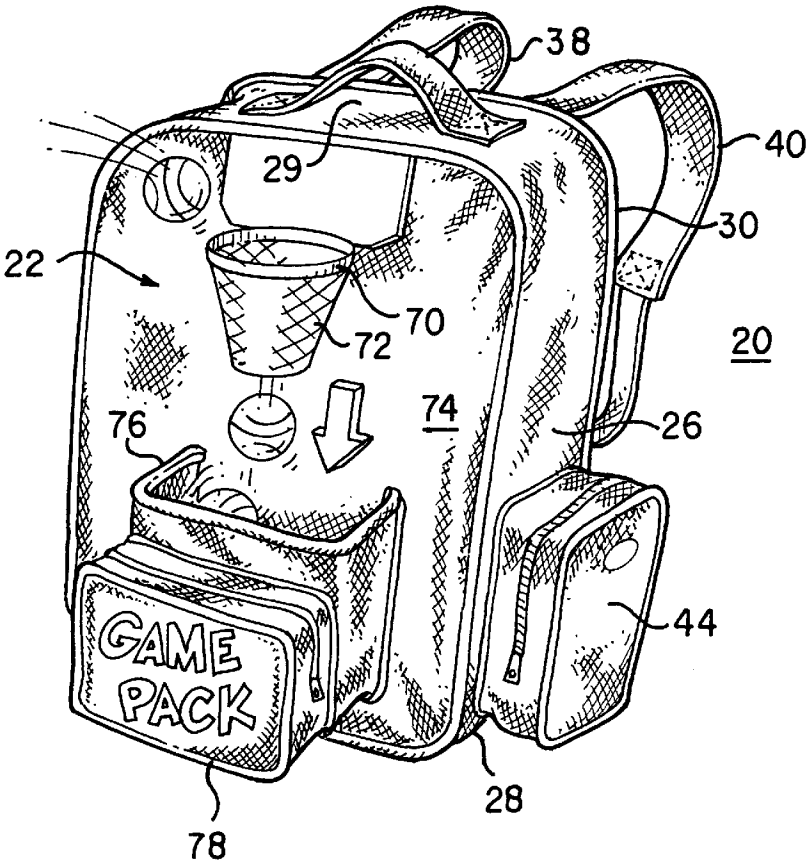
FIG. 2 is a perspective view of the carrying case of FIG. 1 shown with its front panel closed.

The knapsack 20 can contain additional features. For example, FIG. 2 illustrates the knapsack 20 of FIG. 1 having another hoop 70 and net 72 provided on the outer surface 74 of the front panel 22 in the same manner as for attaching the hoop 54 to the surface 52. An open pouch or pocket 76 can be stitched to the outer surface 74 directly below the hoop 70 to catch or receive any ball 68 that has passed through the hoop 70. An outer pocket or pouch 78 can be even be stitched to the pouch 76 to provide additional compartmentalized storage space.

Figure 3:
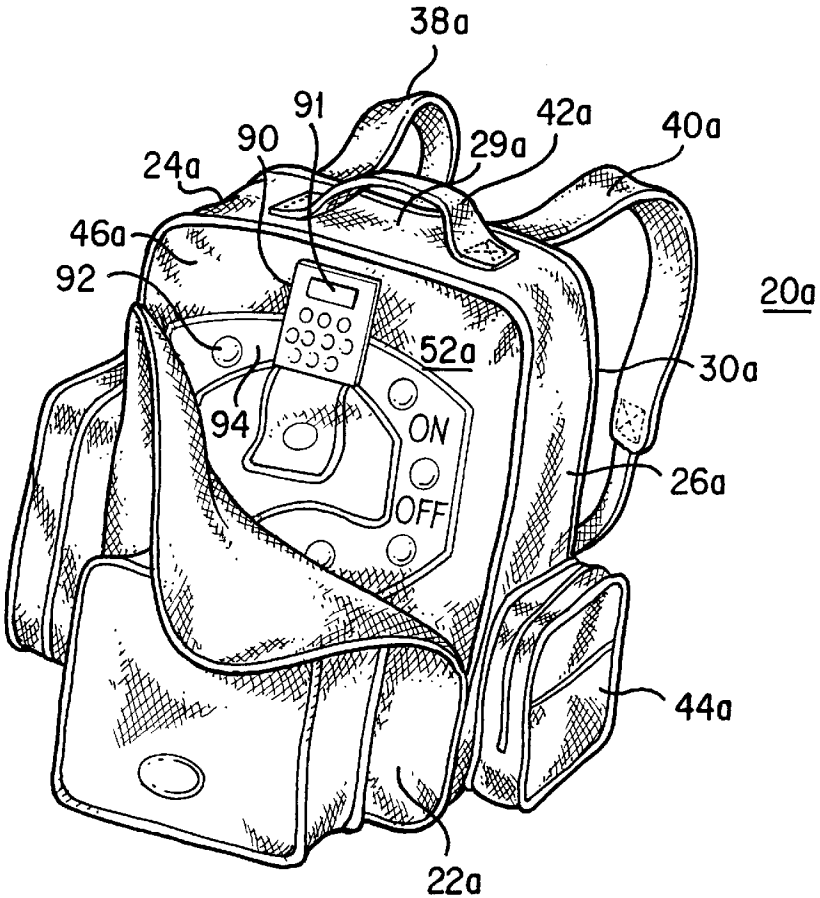
FIG. 3 is a perspective view of a carrying case according to another embodiment of the present invention.

FIG. 3 illustrates a knapsack 20*a* that is the same as the knapsack 20 of FIGS. 1 and 2, except that the inner panel 46*a* is provided with different amusement features. Therefore, the same numerals are used to designate the same corresponding elements in both FIGS. 1 and 3, except that an "a" has been added to the corresponding elements in FIG. 3. In the knapsack 20*a* of FIG. 3, an electronic amusement feature is provided in the form of a speaker unit 90 that is coupled to a plurality of touch pads 92 by an electronic coupling path 94. The speaker unit 90, touch pads 92 and coupling path 94 are attached to the surface 52*a* of the inner panel 46*a*.

Figure 4A:
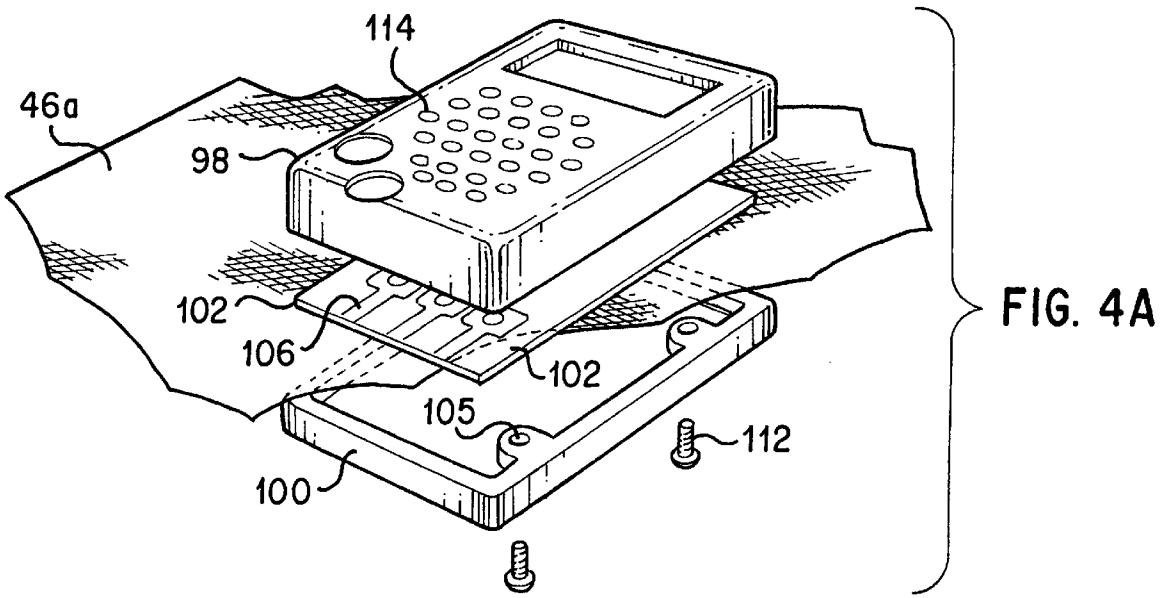
FIG. 4A is an exploded perspective view of a speaker unit of the knapsack of FIG. 3.
Figure 4B:
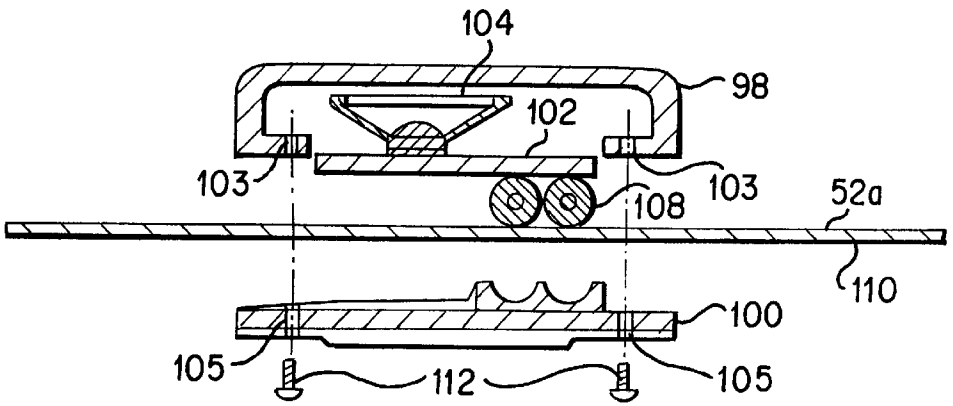
FIG. 4B is an exploded cross-sectional view of the speaker unit of FIG. 4A.
Figure 5:
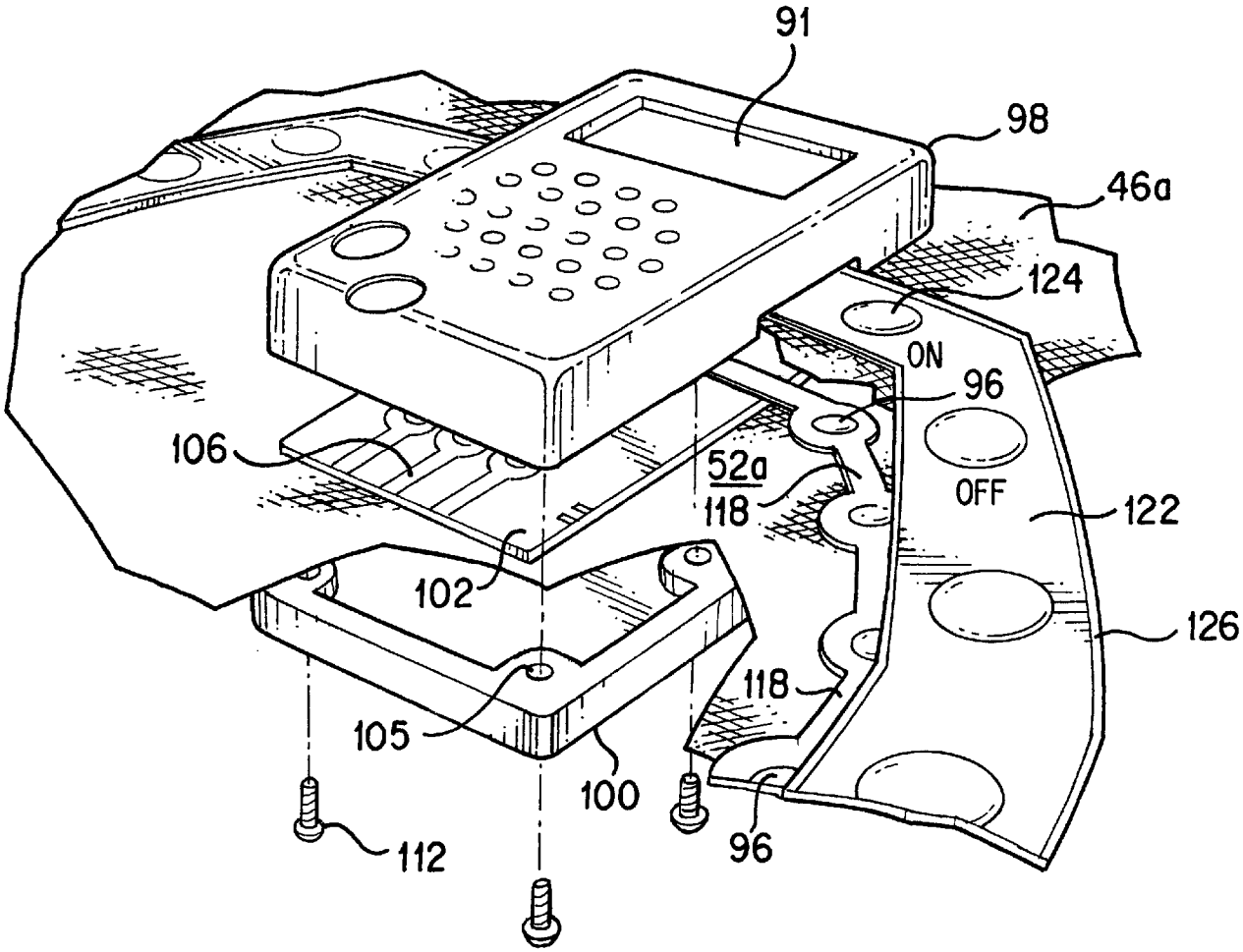
FIG. 5 is an exploded sectional view illustrating the electrical couplings between the speaker unit and touch pads of the knapsack of FIG. 3.

For example, FIGS. 4A, 4B and 5 illustrate how the speaker unit 90 can be attached to the material of the inner panel 46*a*. The speaker unit 90 can comprise a housing that is made up of an outer shell 98 and and inner shell 100. A PC board 102 has a speaker 104 and associated circuitry (e.g., pads 106, chips that might include a processor, etc., as is well known in the art) mounted or provided thereon, and can even have a power source (e.g., batteries 108) coupled thereto for providing power to drive the speaker unit 90 and the touch pads 92 via the coupling path 94. The PC board 102 can be positioned against the surface 52*a* of the inner panel 46*a*, and then the outer shell 98 placed over the PC board 102 and the surface 52*a*, and the inner shell 100 placed against the rear surface 110 of the inner panel 46*a* at the same position as the outer shell 98. The shells 98 and 100 can then be secured together (with the PC board 102 retained inside outer shell 98) by using screws 112 that are threadably inserted through corresponding holes 103 and 105 in the shells 98 and 100, respectively, and the material of the inner panel 46*a*. The outer shell 98 can be provided with a plurality of small openings 114 to allow sound from the speaker 104 to be emitted therethrough. FIG. 5 illustrates one method for electrically coupling the touch pads 96 and speaker unit 90. A plurality of touch pads 96 are attached (e.g., by glue or stitching) to selected locations on the outer surface 52*a* of the inner panel 46*a*, and connected by electrical couplings 118 to each other and to the speaker unit 90. The electrical couplings 118 therefore form the coupling path 94, and in one embodiment can be wires. A fabric or other cover 122 can be provided which is configured or cut to follow the path created by the touch pads 96 and the wires 118. Specific indicia 124 can be stitched or otherwise attached to the locations on the cover 122 that would overlie the corresponding touch pads 92. The cover 122 is then stitched (along stitch lines 126) to the surface 52*a* of the inner panel 46*a* to cover and protect the touch pads 92 and wires 118.

As an alternative, the electrical couplings 118 can be conductive paths. Each conductive path 118 can include the conductive lines, stripes, traces, compositions, inks, liquids, pastes, granules and colored inks, and can utilize the electrical systems and attachment techniques, described in U.S. Pat. No. 5,455,749 to Ferber, U.S. Pat. No. 5,371,657 to Wiscombe, U.S. Pat. No. 5,626,948 to Ferber et al., and U.S. Pat. No. 5,973,420 to Kaiserman et al., whose disclosures are incorporated by this reference as though fully set forth herein, as well as any electrical systems and attachment techniques that are known in the art. One non-limiting example of a material that can be used as a conductive ink is a material sold under the tradename 102-05F by Creative Materials of Tyngsboro, Mass. Other materials are described in one or more of U.S. Pat. No. 5,455,749 to Ferber, U.S. Pat. No. 5,371,657 to Wiscombe, U.S. Pat. No. 5,626,948 to Ferber et al., and U.S. Pat. No. 5,973,420 to Kaiserman et al.

Each touch pad 92 can carry a different indicia 124 (e.g., character, letter, number, etc.), and all the touch pads 92 can together form a path for a game or activity. The variety and amusement value of these games and activities, including any computer-programmed games, will depend on the amusement features provided with the knapsack 20*a*. A screen (e.g., 91 provided in the housing of the speaker unit 90) can even be used to display the results of these games, which can be measured by, for example, sensors on the touch pads 92.

As yet another example, the amusement features can provide the basis for educational games. For example, the speaker unit 90 can broadcast tasks that require a child to do a broadcasted task several times, and having the child count the number of times that the task has been performed. As another example, numbered graphics can be provided on the touch pads 92 and coupled (via the conductive paths and wiring described above) to a processor on the PC board 102, which can control a game in which the different numbered graphics are made to light up at different times, in which a child is to follow lighted graphics on the touch pads 92 in (a) moving about the path created by the touch pads 92, (b) recognizing and repeating the lighted numbers, and (c) adding the lighted number to the previous sum, among others. The speaker unit 90 can make announcements, emit congratulatory praises, or emit any other desired sounds or music. Other variations and themes for games utilizing numbered graphics are also possible, and can vary based on the educational or other objective(s) that are intended to be accomplished.

Figure 11:
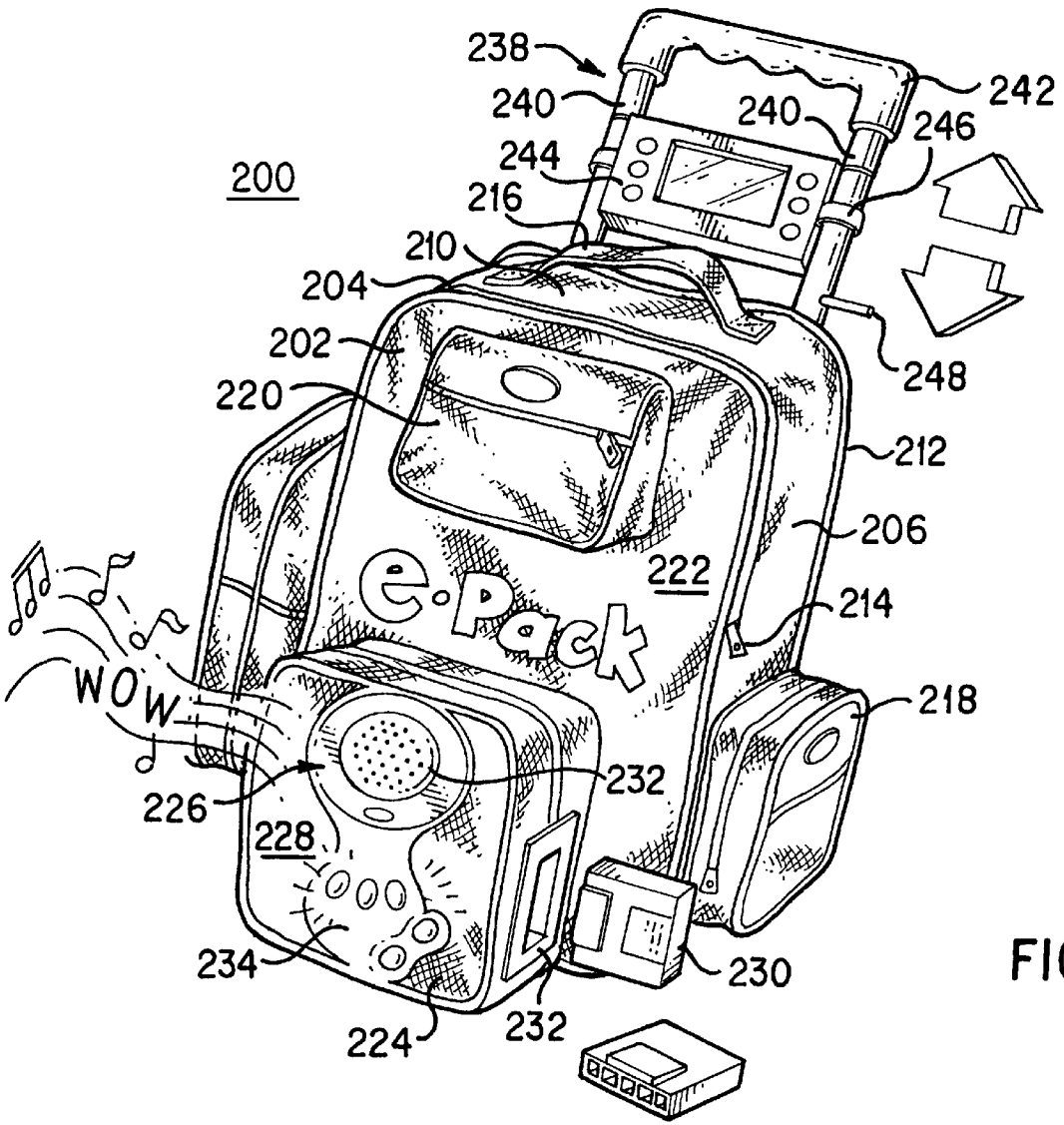

As a further non-limiting example, the touch pads 92, screen 91 and speaker 104 can even be the components that make up an interactive computer system that is capable of communicating (e.g., via wireless transmission as illustrated in FIG. 11 below) with other computing systems. Thus, the carrying case 20*a* can actually form an "interactive" or "computing" station for a user, where the user can use the touch pads 92 as input devices, and the screen 91 as an output device, for playing games, doing word processing, surfing the Internet, and communicating with other computing systems.

Figure 6:
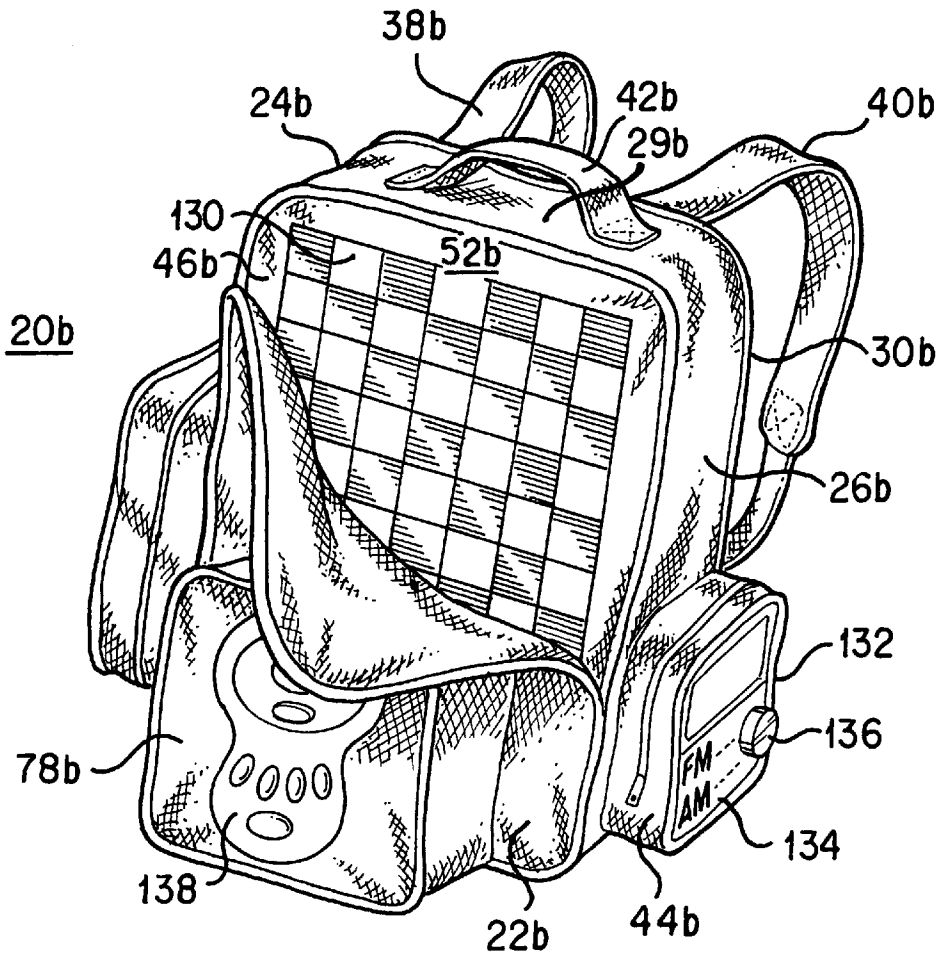
FIGS. 6–8 are perspective views of carrying cases according to other embodiments of the present invention.

FIG. 6 illustrates a knapsack 20*b* that is the same as the knapsack 20 of FIGS. 1 and 2, except that the knapsack 20*b* is provided with different amusement features. Therefore, the same numerals are used to designate the same corresponding elements in both FIGS. 1 and 6, except that a "b" has been added to the corresponding elements in FIG. 6. In the knapsack 20*b* of FIG. 6, a game board 130 is provided on the surface 52*b* of the inner panel 46*b*. The game board 130 can be a fabric piece that is stitched on to the surface 52*b*, or can be formed by a stitch pattern that makes up the desired game board design. In addition, a radio 132 can be associated with the pouch 44*b*. For example, the radio 132 can be provided with a housing (having outer and inner shells) similar to the speaker unit 90 illustrated in FIGS. 4A and 4B, and attached to the outer panel 134 of the pouch 44*b* in the same manner illustrated in FIGS. 4A and 4B, so that the controls and dials 136 of the radio 132 can extend outside the pouch 44*b* for the user to manipulate. As a result, the pouch 44*b* can still be used for storage. Yet another amusement feature associated with the knapsack 20*b* is another electronic appliance 138 (such as a speaker unit, CD player, cassette player, screen display, etc.) that can be attached to the outer pouch 78*b* in the same manner that the radio 132 is attached to the pouch 44*b*. Thus, the knapsack 20*b* provides the user with a variety of different amusement features: a game board for use in playing a game, a radio for listening to music or the news, and another electronic appliance, such as a CD or cassette player for playing the user's favorite music.

Figure 7:
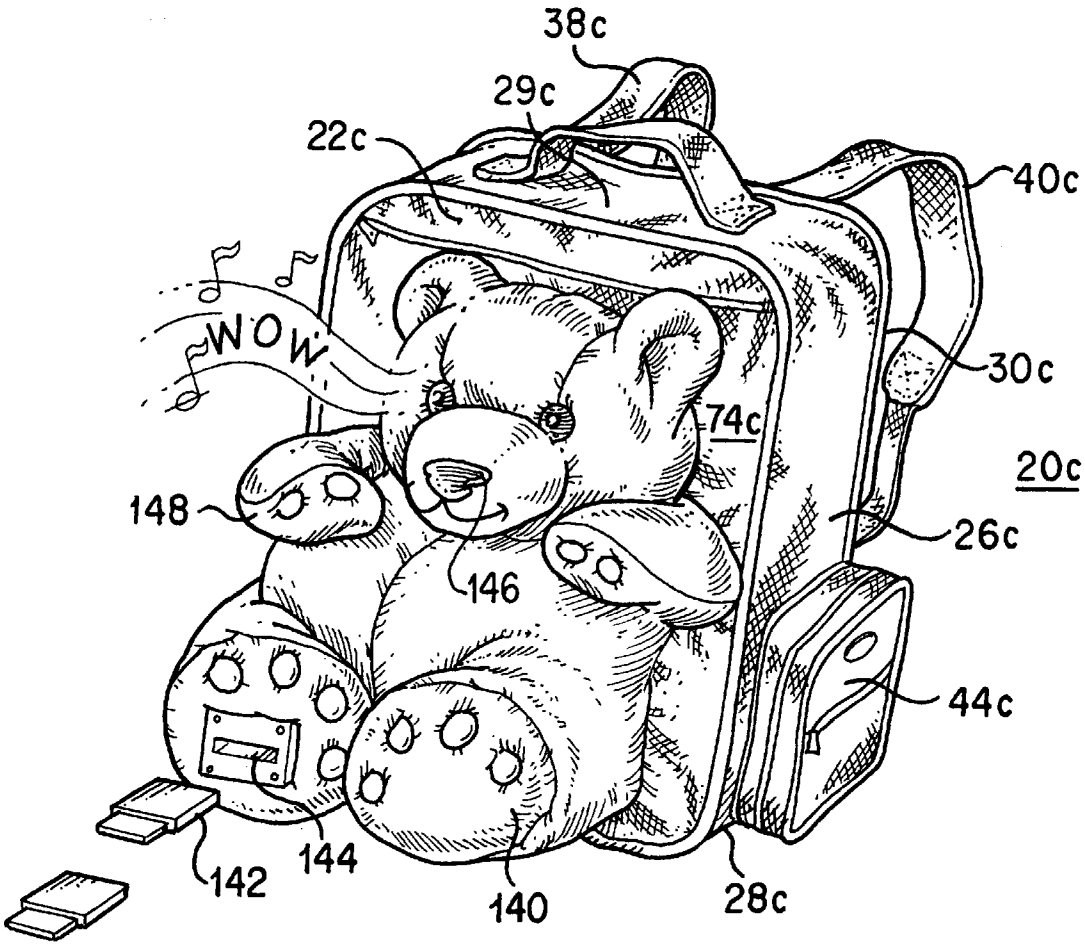

FIG. 7 illustrates a knapsack 20*c* that is the same as the knapsack 20 of FIGS. 1 and 2, except that the knapsack 20*c* is provided with different amusement features. Therefore, the same numerals are used to designate the same corresponding elements in both FIGS. 1 and 7, except that a "c" has been added to the corresponding elements in FIG. 7. In the knapsack 20*c* of FIG. 7, a stuffed toy 140 like a teddy bear) can be attached (e.g., by stitching) to the outer surface 74*c* of the front panel 22*c*. The stuffed toy 140 can house a conventional electronic playstation, music machine, or other electronic device having, for example, a processor utilizing technology that is well-known in the art. A user can insert game cartridges 142 into a game port 144 in the stuffed toy 140. For example, the game cartridge 142 can contain recorded music that can be played by a speaker 146 built in to the stuffed toy 140. Alternatively, the cartridge 142 can contain software that controls movements of the arms 148 of the stuffed toy 140.

Figure 8:
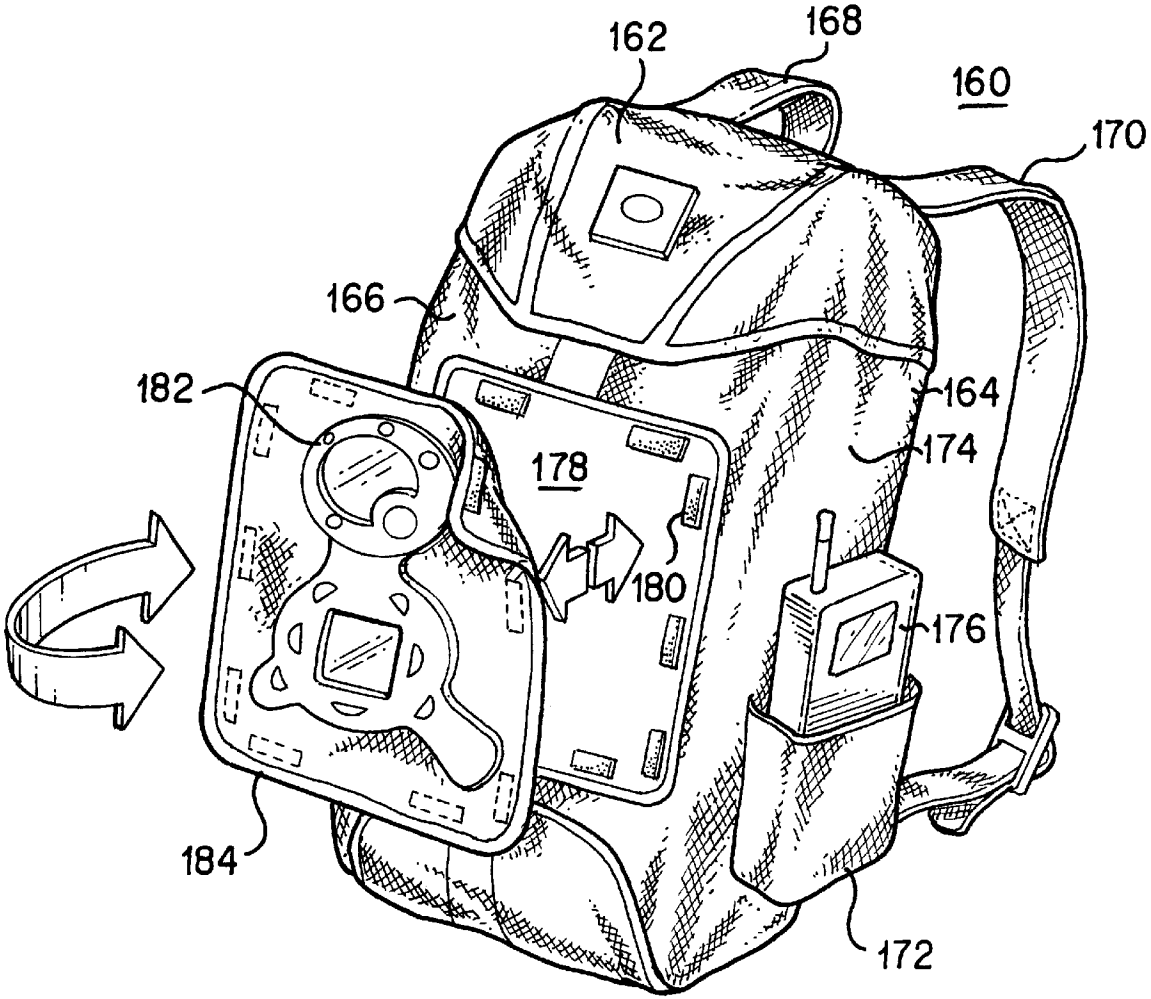

FIG. 8 illustrates another embodiment of the present invention in the form of another knapsack 160. The knapsack 160 is similar to knapsack 20, except that instead of well-defined panels 22, 24, 26, 28, 29, and 30 interconnected with each other, the main body of the knapsack 160 is formed like a large pouch. In addition, the knapsack 160 has an upper lid or cover 162 having one end that pivots from the rear panel 164 to cover the top opening of the knapsack 160, and an opposing end that is secured to the front panel 166 by any conventional means used by bags and handbags, such as by buckles, snaps, hooks, Velcro™ pads, loops, and the like. A pair of adjustable straps 168, 170 are attached at ends thereof (e.g., by stitching) to spaced-apart locations along the rear panel 164. A storage pouch 172 can also be stitched to the side panel 174 to function as a side pocket for retaining certain smaller items (e.g., a notepad or cellular phone 176).

Figure 9:
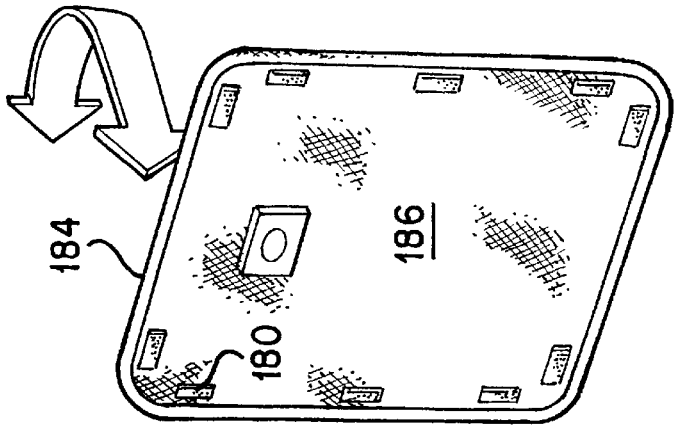
FIG. 9 is a rear perspective view of the backing in FIG. 8.

The outer surface 178 of the front panel 166 is provided with removable or releasable attachment mechanisms (e.g., VELCRO™ pads 180 as shown in FIG. 8, or hooks, straps, buckles, loops, etc.) for removably coupling one or more amusement features. For example, an electronic device 182 (such as one or more of a mini game computer, a speaker, a CD-player, a display screen, among others) can be provided on a backing or support 184 (see also FIG. 9). The backing 184 can be made from a hard fabric, cardboard, or any similar material that has sufficient rigidity to support the electronic device, yet is sufficiently lightweight. The electronic device 182 can be provided with a housing (having outer and inner shells) similar to the speaker unit 90 illustrated in FIGS. 4A and 4B, and attached to the backing 84 in the same manner illustrated in FIGS. 4A and 4B. The rear surface 186 of the backing 184 can have a complementary removable attachment mechanism (e.g., VELCRO™ pads 180) for removably attaching the backing 184 to the outer surface 178 of the front panel 166. Thus, the knapsack 160 provides the user with the variety and flexibility of changing the amusement feature on the front panel 166, since a plurality of different amusements features (electronic or non-electronic) can be provided for removable attachment to the front panel 166.

Figure 10:
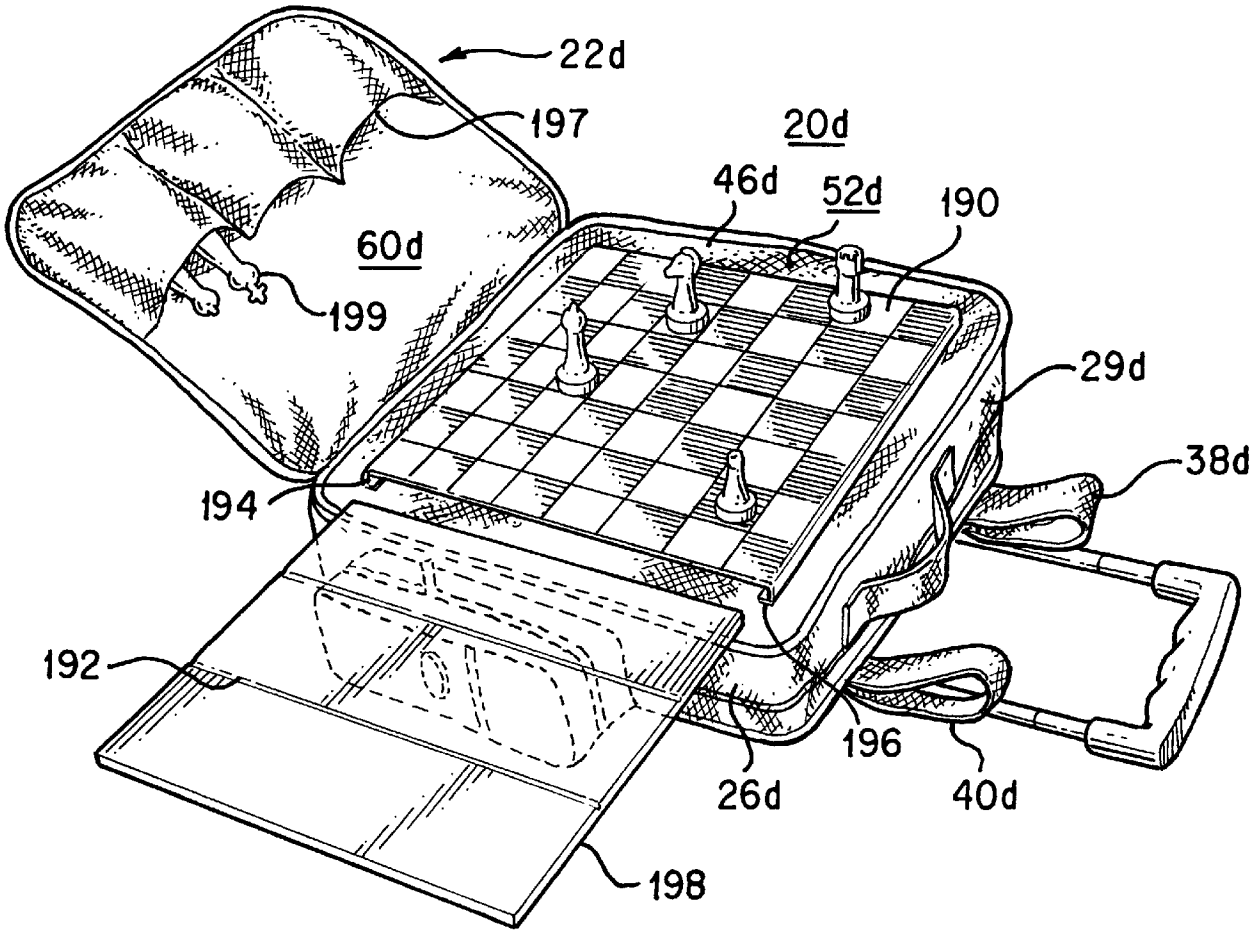
FIGS. 10–13 are perspective views of carrying cases according to other embodiments of the present invention.

FIG. 10 illustrates a knapsack 20*d* that is the same as the knapsack 20 of FIGS. 1 and 2, except that the inner panel 46*d* is provided with different amusement features. Therefore, the same numerals are used to designate the same corresponding elements in both FIGS. 1 and 10, except that a "d" has been added to the corresponding elements in FIG. 10. In the knapsack 20*d* of FIG. 10, a game board 190 is provided on the surface 52*d* of the inner panel 46*d*. The game board 190 can be a fabric piece that is stitched on to the surface 52*d*, or can be formed by a stitch pattern that makes up the desired game board design. Alternatively, a fabric piece having the game board 190 (or any other pattern, indicia or design) provided thereon can be stitched to the surface 52*d* in a manner to form a sleeve. In particular, opposing edges 194 and 196 of the game board fabric 190 can be stitched to the surface 52*d*, and an external pad 198 can be slid into the sleeve to function as a support for the game board 190. The pad 198 can be removed if desired.

The pad 198 functions to provide a solid or rigid backing for the game board 190 or other feature. The pad 198 can be made from a lightweight material that is capable of providing sufficiently rigidity to function as a game board or to support an activity thereon, and can include materials such as, but not limited to, cardboard, is plastic, a thin metal sheet (such as aluminum), wood, fiberglass, resin and foam, among others. The pad 198 can be provided in any desired size, but the pad 198 should have a size that is at least large enough to provide a backing and support for the game board 190. The pad 198 can be provided in a corrugated form or with pre-folds 192 to allow the pad 198 to be folded for storage. Finally, the inner surface 60*d* of the front panel 22*d* can be provided with small pockets 197 that can be used to hold game pieces 199 or other articles.

FIG. 11 illustrates another embodiment of the present invention which takes the form of a travel carrying case 200 that can have amusement features incorporated therewith. The carrying case 200 can be adapted to store clothing and other luggage items during travel, or can even be used as a school bag. The carrying case 200 is constructed of a front panel 202, side panels 204 and 206, a bottom panel (not shown), a top panel 210, and a rear panel 212 interconnected with each other, such as by stitching, to form an enclosed storage space. The front panel 202 and the rear panel 212 are substantially flat (i.e., planar) and have a generally rectangular shape to provide the carrying case 200 with a generally rectangular appearance. The front panel 202 can be attached along peripheral edges thereof to opposed side panels 204, 206 and the top panel 210 by a zipper 214 having at least one zipper tab interacting with two intermeshing tracks, a first track on the peripheral edges of the front panel 202, and a second track extending along the side panels 204, 206 and the top panel 210. Each of the panels 202, 204, 206, 210, 212 can be made from any fabric material (e.g., nylon, cloth, hard cotton) vinyl or leather.

A handle 216 can be secured to the top panel 210 to allow the carrying case 200 be lifted and carried by hand. A storage pouch 218 can also be stitched to the side panel 206 to function as a side pocket for retaining certain smaller items (e.g., keys). A second storage pouch 220 can be stitched to the outer surface 222 of the front panel 202 adjacent the top panel 210. A third storage pouch 224 can be stitched to the outer surface 222 of the front panel 202 adjacent the bottom panel. An electronic device 226 (such as one or more of a mini game computer, a speaker, a CD-player, lights, a display screen, among others) can be provided with a housing (having outer and inner shells) similar to the speaker unit 90 illustrated in FIGS. 4A and 4B, and then attached to the outer panel 228 of the pouch 44*b* in the same manner illustrated in FIGS. 4A and 4B. A user can also insert game cartridges 230 into a game port 232 in the side of the pouch 224. For example, the game cartridge 230 can contain recorded music that can be played by a speaker 232. Alternatively, the cartridge 230 can contain software that controls the flashing or blinking of a plurality of lights 234. The interior of the pouch 224 can house a processor and associated electronic components that allow game cartridges 230 to control the operation of the electronic device(s) 226 using techniques that are well-known in the art.

In addition, the carrying case 200 includes a slidable handle 238 that is made up of two parallel vertical sliding bars 240, and a handle bar 242 connecting the top of the sliding bars 240. The sliding bars 240 can be lifted up and locked in use, or can be slid downwardly into a sleeve or pocket (see sleeve 276 in FIG. 15, for example) in the carrying case 200 to be retained therein. Such slidable handles 238 are well-known in the luggage art, and are not described in greater detail herein. In the carrying case 200, an electronic device 244 can be provided between and supported by the sliding bars 240. For example, a mini-computer 244 can have its housing either permanently (e.g., screwed or welded) to the sliding bars 240, or can have its housing removably coupled (e.g., by hooks, loops 246 as shown in FIG. 11, or VELCRO™ pads, among others) to the sliding bars 240. Thus, the mini-computer 244 can be stored in the sleeve or pocket (such as 276 in FIG. 15) in the carrying case 200 when the sliding bars 240 are lowered and stored. In addition, an antenna 248 can be electrically coupled to the mini-computer 244 via a bar 240 so that the mini-computer 244 can be used for wireless (e.g., RF) communication with another remote computer.

Thus, the carrying case 200 provides the user with a wide variety of amusement devices that can be provided on a pouch 224 on the front panel 202, or even on the slidable handle 238.

Figure 12:
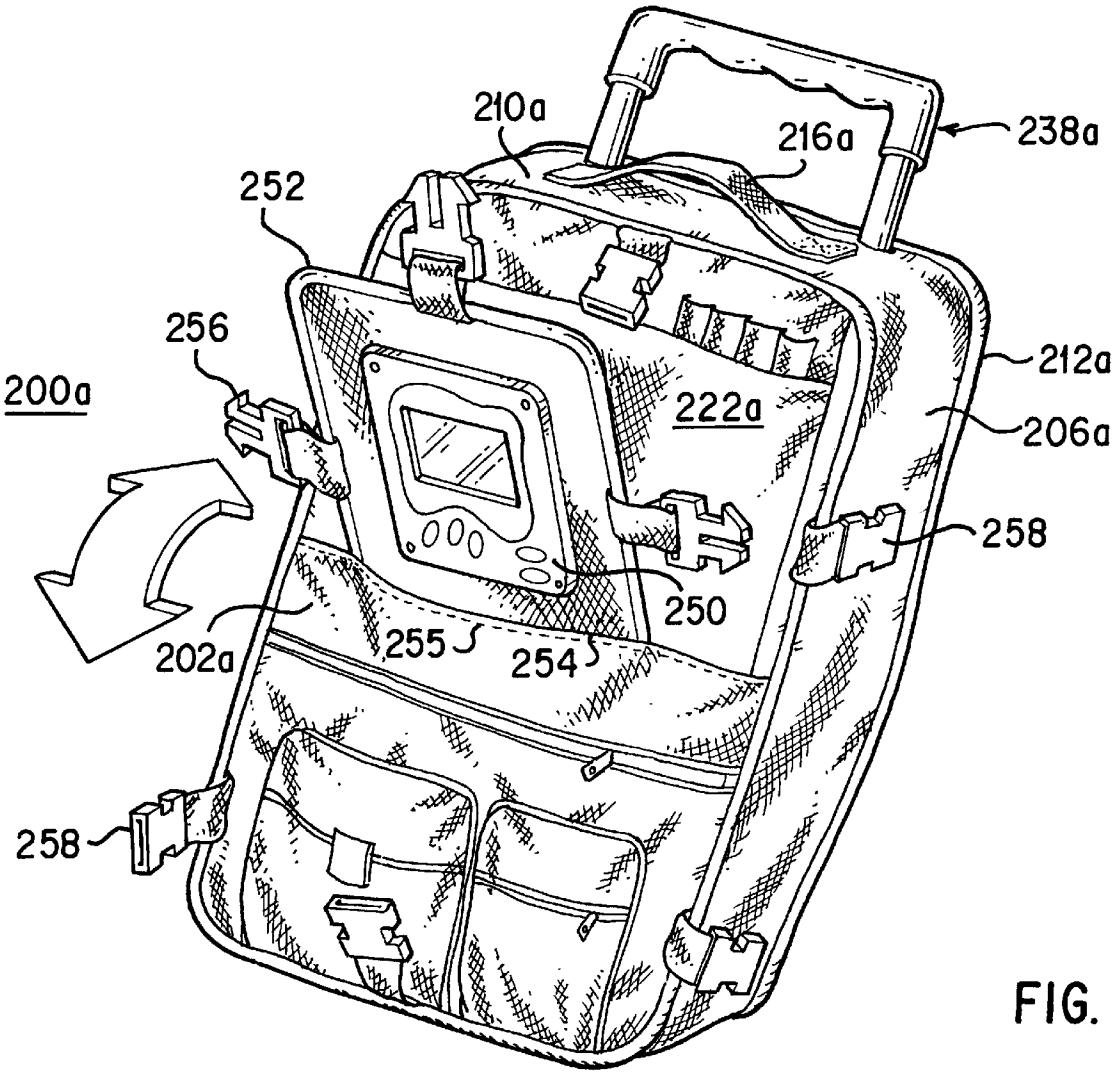

FIG. 12 illustrates a carrying case 200*a* that is the same as the carrying case 200 of FIG. 11, except for the different amusement features noted below. Therefore, the same numerals are used to designate the same corresponding elements in both FIGS. 11 and 12, except that an "a" has been added to the corresponding elements in FIG. 12. In the carrying case 200*a* of FIG. 12, an amusement feature can be provided in the form of a foldable electronic device 250. The electronic device 250 (such as one or more of a mini game computer, a speaker, a CD-player, a display screen, among others) can be provided on a backing or support 252. The backing 252 can be made from a hard fabric, cardboard, or any similar material that has sufficient rigidity to support the electronic device, yet is sufficiently lightweight. The electronic device 250 can be provided with a housing (having outer and inner shells) similar to the speaker unit 90 illustrated in FIGS. 4A and 4B, and attached to the backing 252 in the same manner illustrated in FIGS. 4A and 4B. The backing 252 can have a lower edge 254 that is hingedly connected (e.g., by stitching 255) to the front panel 202*a* at a location such that the backing 252 can be pivoted to two separate positions: a use position with the rear surface of the backing 252 facing the surface 222*a* of the front panel 202*a*, and a storage position with the electronic device 250 facing the surface 222*a* of the front panel 202*a*. Removable or releasable attachment mechanisms (e.g., opposing buckles 256 and latches 258, or hooks and straps, or opposing VELCRO™ pads, etc.) can be positioned along the edges of the backing 252 and the surface 222*a* of the front panel 202*a* to secure the backing 252 and its electronic device 250 in either the use position or the storage position. Thus, the user can conceal the electronic device 250 by securing it in the storage position, and can then pivot the backing 252 to the use position to use the electronic device 250.

Figure 14:
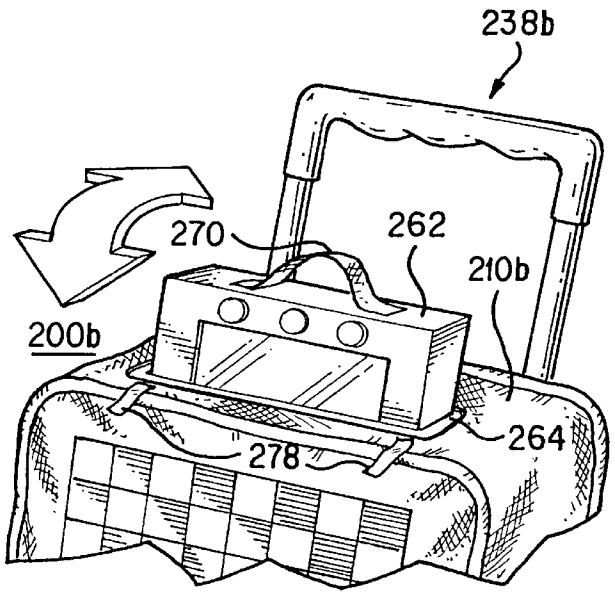
FIG. 14 is a sectional view of the carrying case of FIG. 13.
Figure 13:
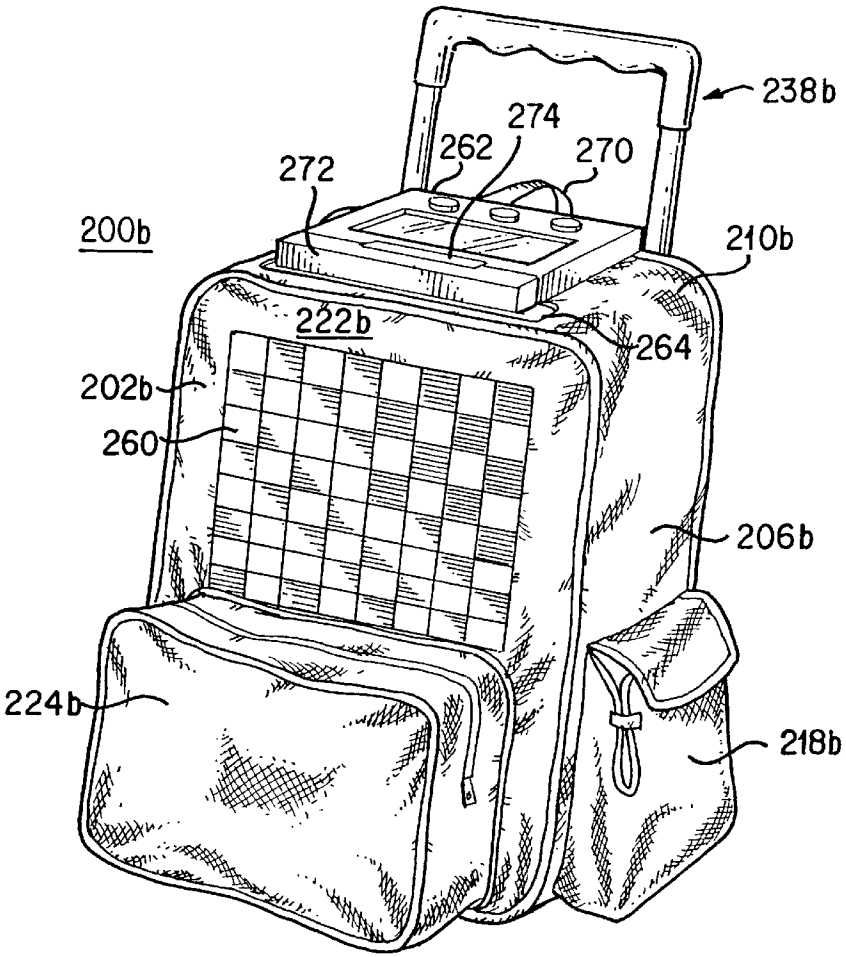
Figure 15:
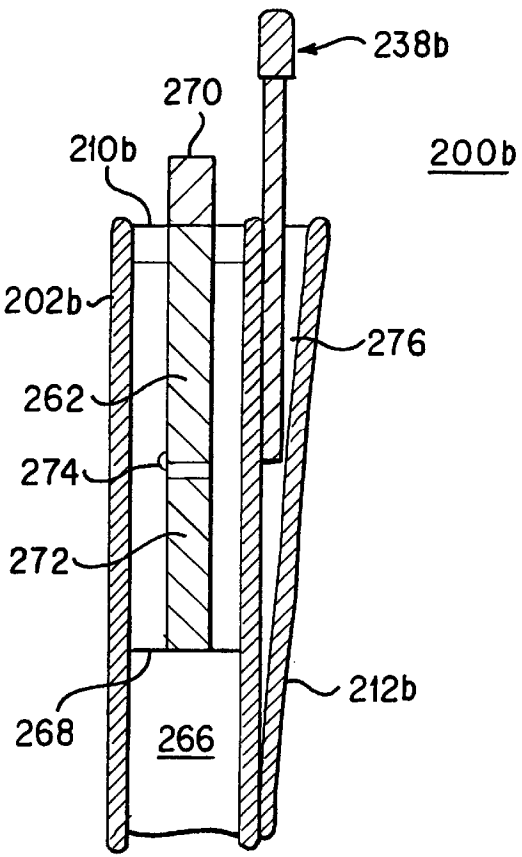
FIG. 15 is a side cross-sectional view of the carrying case of FIG. 13.

FIGS. 13–15 illustrate a carrying case 200*b* that is the same as the carrying case 200 of FIG. 11, except for the different amusement features noted below. Therefore, the same numerals are used to designate the same corresponding elements in both FIGS. 11 and 13, except that a "b" has been added to the corresponding elements in FIG. 13. In the carrying case 200*b* of FIG. 13, a game board 260 can be provided on the front surface 222*b* of the front panel 202*b*. In addition, an electronic device 262 can be retained inside the interior 266 of the carrying case 200*b* and removed via an elongated opening 264 provided in the top panel 210*b*. For example, a mini-computer 262 can be provided in a housing that has a slim profile, and as shown in FIGS. 14 and 15, can be inserted via the opening 264 into the interior 266 of the carrying case 200*b*. A stop wall 268 can be provided in the interior 266 to prevent the mini-computer 262 from falling completely into the interior 266. A handle 270 can be provided on the top of the mini-computer 262 and adapted to always extend outside the opening 264, so that the user can grip the handle 270 to pull the mini-computer 262 out of the interior 266 at any time. In addition, a support piece 272 can be hingedly coupled to the housing for the minicomputer 262 by a hinge 274, such as a piano hinge. Thus, the support piece 272 and the housing of the mini-computer 262 actually form a slim and elongated piece that extends into the interior 266. The bottom of the support piece 272 actually abuts the stop wall 268 when the mini-computer 262 is completely retained inside the interior 266. When the user desires to use the mini-computer 262, the user pulls the handle 270 to lift the mini-computer 262, and then pivots the mini-computer 262 about the hinge 274 so that the housing of the mini-computer 262 can be placed flat on top of the top panel 210*b* during use, as shown in FIG. 13. Optional locking mechanisms, such as a strap 278 with a fastener button or VELCRO™ pads provided thereon, can be provided on the top panel 210*b* to secure the mini-computer 262 inside the interior 266 during storage. As a result, the amusement feature 262 (here, it is a mini-computer) can be stored inside the carrying case 200*b* in a manner so that it can be easily and quickly retrieved without needing to open the carrying case 200*b* and to separate the other stored contents.

In addition, as shown in FIG. 15, the slidable handle 238*b* can be retained inside a sleeve 276 provided adjacent the rear panel 212*b* of the carrying case 200*b*.

Figure 17A:
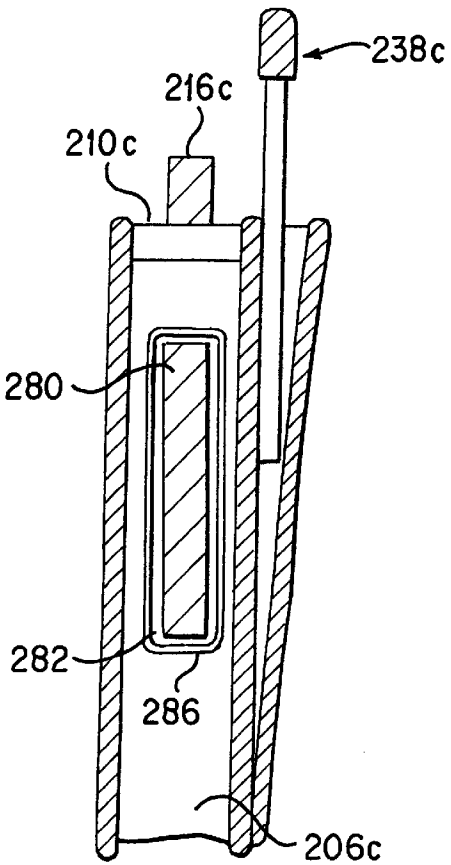
FIG. 17A is a side cross-sectional view of the carrying case of FIG. 16.
Figure 17B:
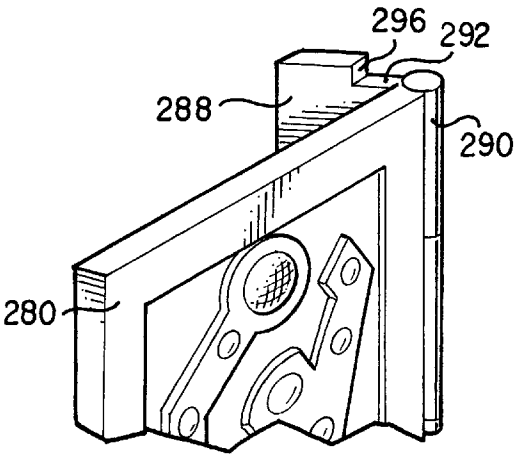
FIG. 17B is a sectional view of the electronic device of FIG. 16.
Figure 16:
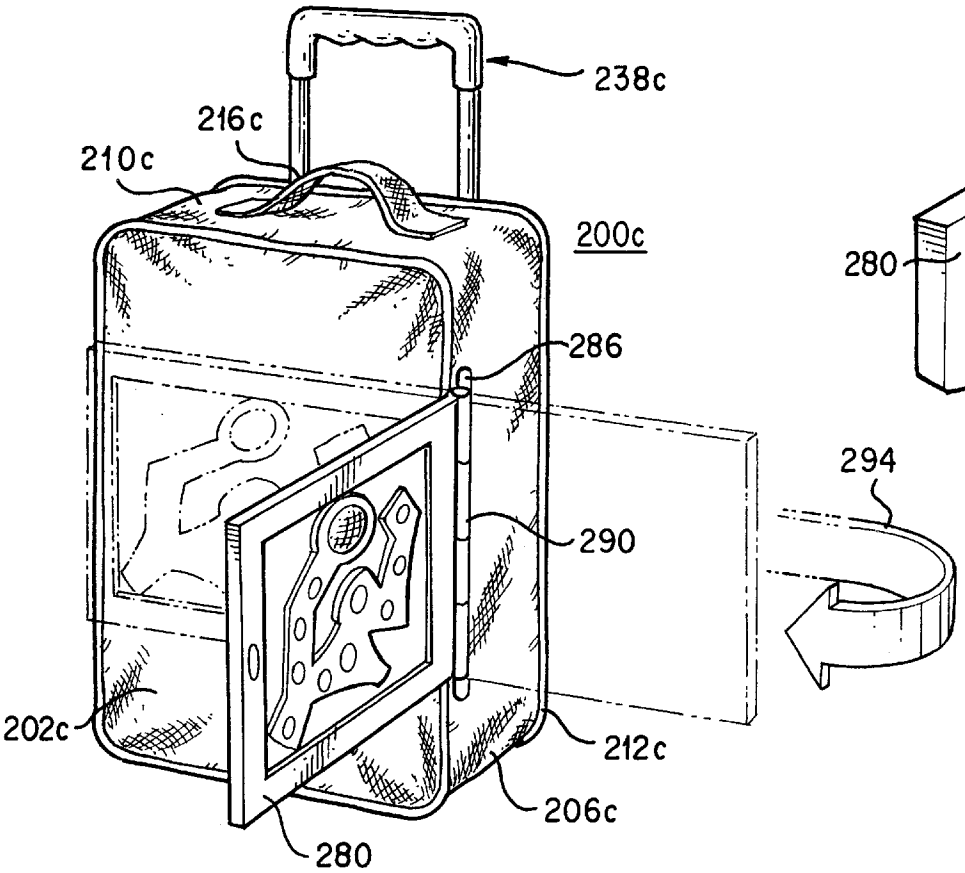
FIG. 16 is a perspective view of a carrying case according to another embodiment of the present invention.

FIGS. 16–17 illustrate a carrying case 200*c* that is the same as the carrying case 200 of FIG. 11, except for the different amusement features noted below. Therefore, the same numerals are used to designate the same corresponding elements in both FIGS. 11 and 16, except that a "c" has been added to the corresponding elements in FIG. 16. In the carrying case 200*c* of FIG. 16, an electronic device 280 can be retained inside a sleeve 282 provided in the interior 284 of the carrying case 200*c* and removed via an elongated opening 286 provided in the side panel 206*c*. For example, a mini-computer 280 can be provided in a housing that has a slim profile, and as shown in FIGS. 16, 17A and 17B, can be inserted via the opening 286 into the sleeve 282 of the carrying case 200*b*. Straps (similar to straps 278 in FIG. 14) can be provided on the side panel 206*c* to retain the electronic device 280 inside the sleeve 282.

Referring to FIGS. 16 and 17B, the electronic device 280 can have a slim housing that is hingedly or pivotably coupled to a retainer piece 288 via a hinge 290 (such as a piano hinge). The retainer piece 288 is always retained inside the sleeve 282, with the height of the retainer piece 288 being greater than the height or length of the opening 286 so that the retainer piece 288 cannot be removed from the sleeve 282. The retainer piece 288 has a narrowed portion 292 that is connected to the hinge 290. The narrowed portion 292 has a height which is slightly less than the height or length of the opening 286 so that the narrowed portion 292 can extend through the opening 286. Thus, when the electronic device 280 is to be stored completely inside the sleeve 282, the retainer piece 288 and the housing of the electronic device 280 are aligned in the same plane, and slid into the sleeve 282. When the electronic device 280 is to be used, the housing of the electronic device 280 can be pulled out of the sleeve 282 through the opening 286, and then pivoted (see arrow 294) about the hinge 290 to any desired orientation for use. FIG. 16 illustrates some possible orientations for the electronic device 280, with some shown in phantom. The vertical edge 296 of the retainer piece 288 that extends from the narrowed portion 292 acts as a stop edge that abuts the wall surrounding the opening 286 to prevent the retainer piece 288 from being pulled outside the sleeve 282. A similar stop edge is provided at the bottom of the retainer piece 288 adjacent the narrowed portion 292. Thus, the disposition of the retainer piece 288 inside the sleeve 282 provides the electronic device 280 with the support and stability needed during use thereof.

Figure 18:
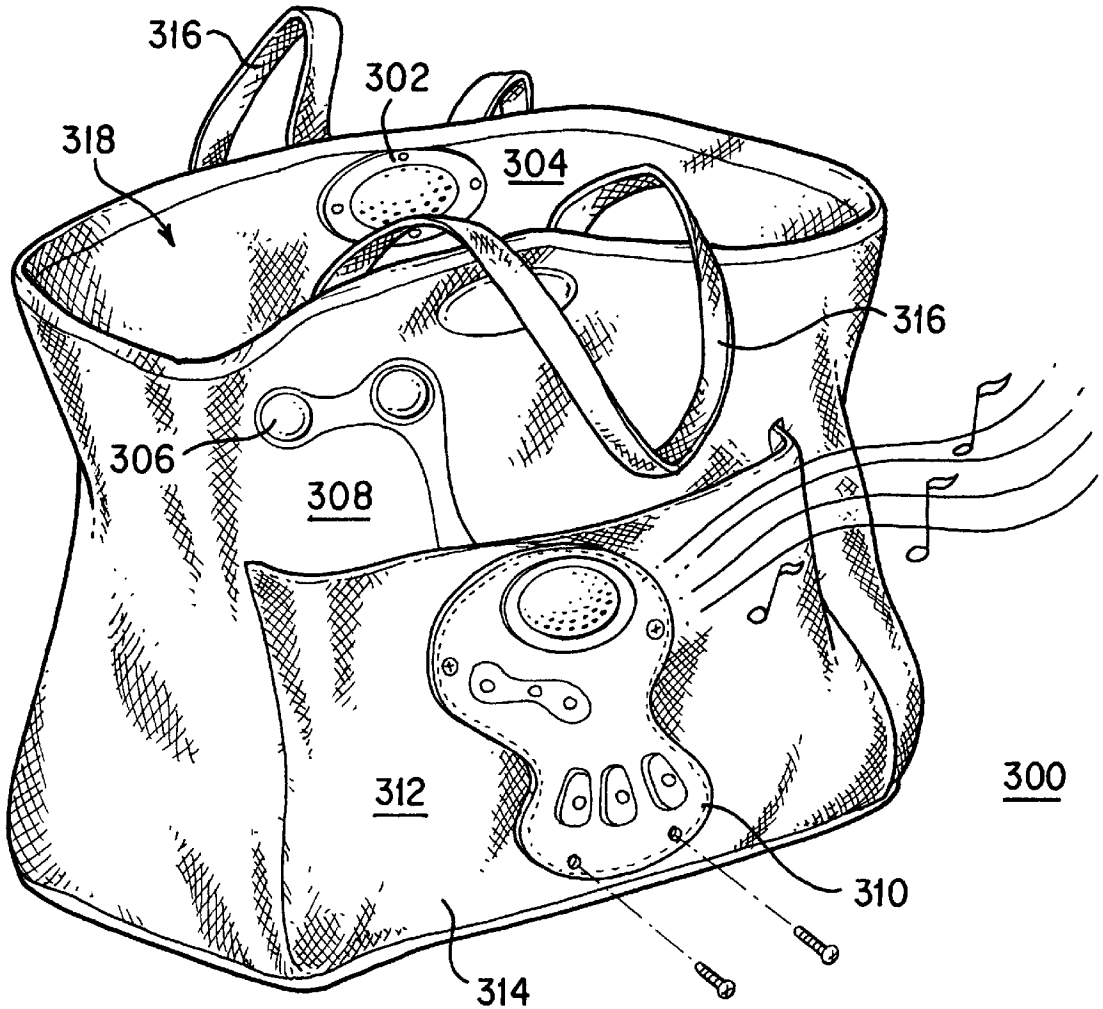
FIGS. 18–23 are perspective views of carrying cases according to other embodiments of the present invention.

Although the principles of the present invention have been illustrated in connection with knapsacks and travel carrying cases, it is possible for the principles of the present invention to be applied to any other carrying case or storage bag so as to enhance the amusement and utility of such carrying cases and storage bags. For example, FIG. 18 illustrates a conventional open-top handbag or tote bag 300 having a light 302 provided on an inner surface 304 of the bag 300, flashing lights 306 provided on an outer surface 308, and a speaker and miniature PC device 310 provided on the outer surface 312 of a pouch 314 that is attached to the outer surface 308. The electronic devices 302, 306 and 310 can be attached to the surfaces of the bag 300 using the principles illustrated in FIGS. 4A and 4B. A pair of handle straps 316 can be provided adjacent the open top 318 of the bag 300. Here, the light 302 can be used to illuminate the interior of the bag 300, the flashing lights 306 can be used to attract attention (e.g., as an alarm), and the speaker and miniature PC device 310 can be used for amusement. Thus, each electronic device 302, 306 and 310 can be used to provide an important safety or amusement function.

Figure 19:
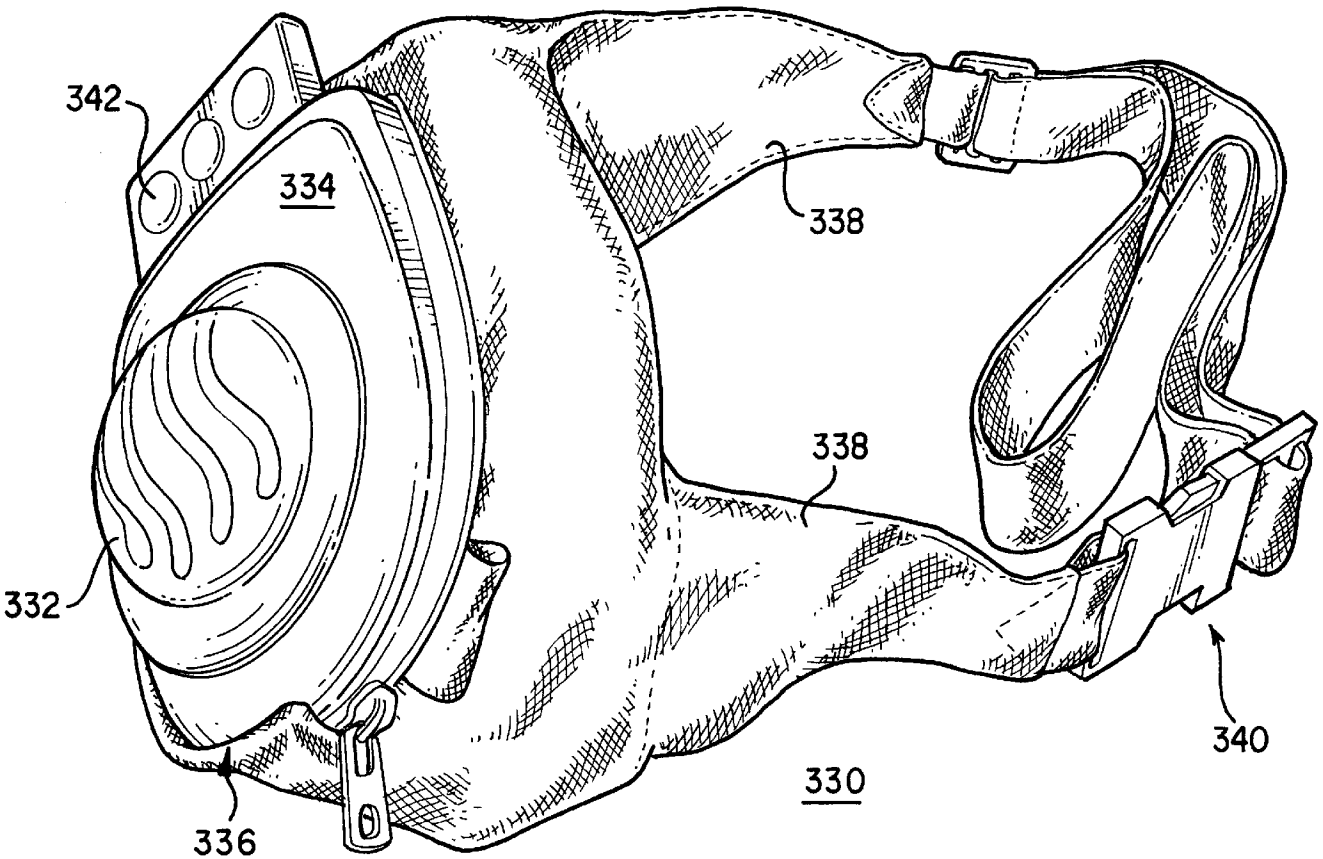

As another example, FIG. 19 illustrates a conventional waist pack 330 having an electronic device 332 (e.g., a built-in CD-player with speaker) provided on an outer surface 334 of the pack 330. The electronic device 332 can be attached to the surface 334 of the container portion 336 of the pack 330 using the principles illustrated in FIGS. 4A and 4B. The waist pack 330 also has two elongated straps 338 that have a buckle and loop connector 340 at the ends of the straps 338 for connecting the straps 338. Here, the CD-player and speaker 332 can provide the wearer of the pack 330 with entertainment during long walks. Alternatively, the pack 330 can be used by a tourist and the CD-player and speaker 332 can be used to narrate information relating to a tourist attraction which the tourist is visiting. Control buttons 342 can be provided on the CD-player and speaker 332 to allow for control thereof.

Figure 20:
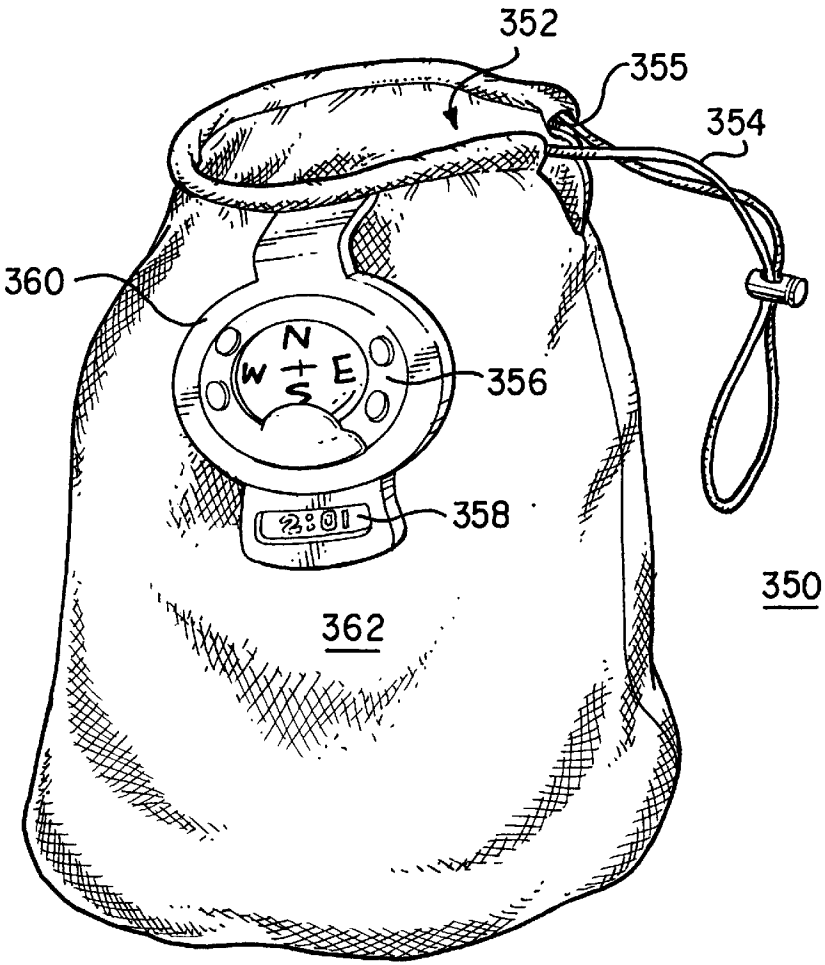

FIG. 20 illustrates another conventional open-top handbag or tote bag 350 whose open top 352 can be closed by a drawstring 354 retained in a sleeve 355 at the top edge thereof. The bag 350 can have a compass 356 and a clock or timer 358 provided on a buckle 360 on an outer surface 362 of the bag 350. The compass 356 and clock 358 can be attached to the surface 362 of the bag 350, or to the buckle 360, using the principles illustrated in FIGS. 4A and 4B. The drawstring 354 can be used as a handle for the bag 350. The compass 356 can be useful in helping the user to identify the user's location, and the clock 358 provides the time.

Figure 21:
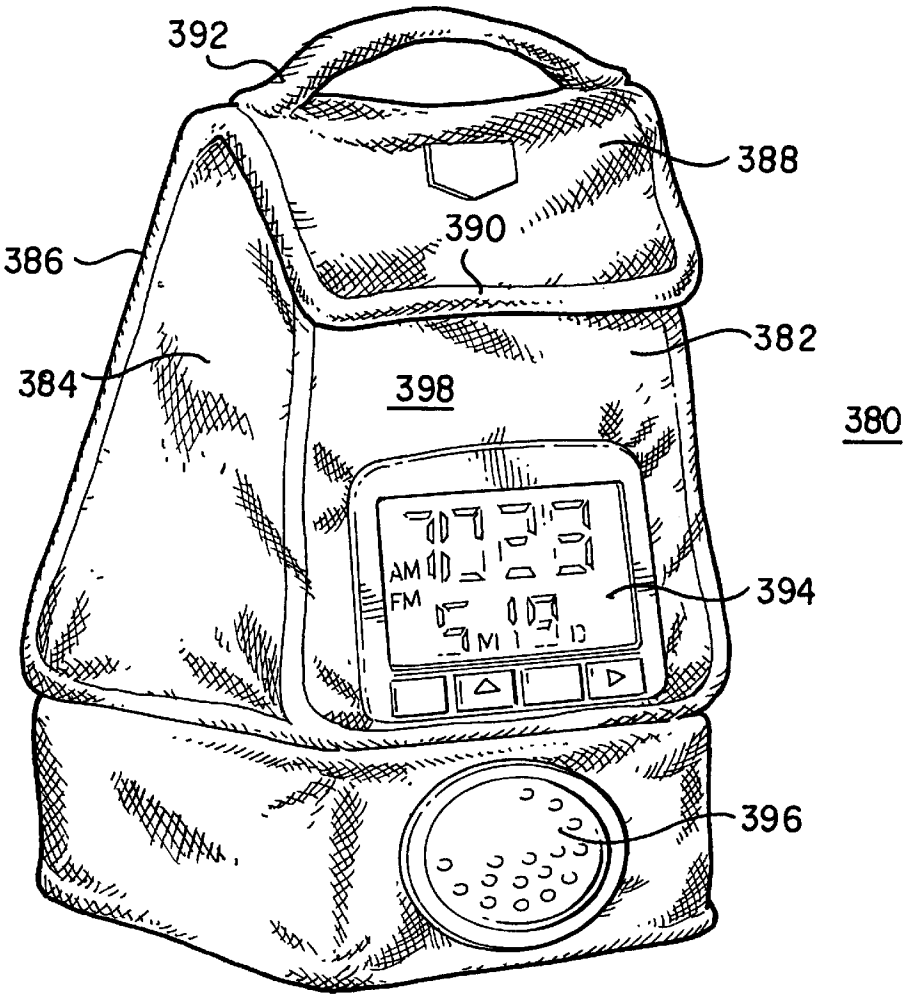

FIG. 21 illustrates a conventional lunch box 380 having an interior defined by a front panel 382, side panels 384, and a rear panel 386 interconnected with each other. The lunch box 380 also has an upper lid or cover 388 that can be an extension from the rear panel 386 that covers the top opening of the lunch box 380. One end 390 of the cover 388 is secured to the front panel 382 by any conventional means used by bags and handbags, such as by buckles, snaps, hooks, Velcro™ pads, loops, and the like. A handle 392 can be provided at the top of the cover 388. A first electronic device 394 (such as a radio and/or cassette player) and a second electronic device 396 (such as a speaker that can be electrically coupled to the first electronic device 394 via wiring disposed inside the lunch box 380) can be provided on the outer surface 398 of the front panel 382. The electronic devices 394 and 396 can be attached to the surface 398 of the lunch box 380 using the principles illustrated in FIGS. 4A and 4B. Here, the radio 394 and speaker 396 can be used to provide musical entertainment to the person during lunch when this person is eating from the contents of the lunch box 380.

Figure 22:
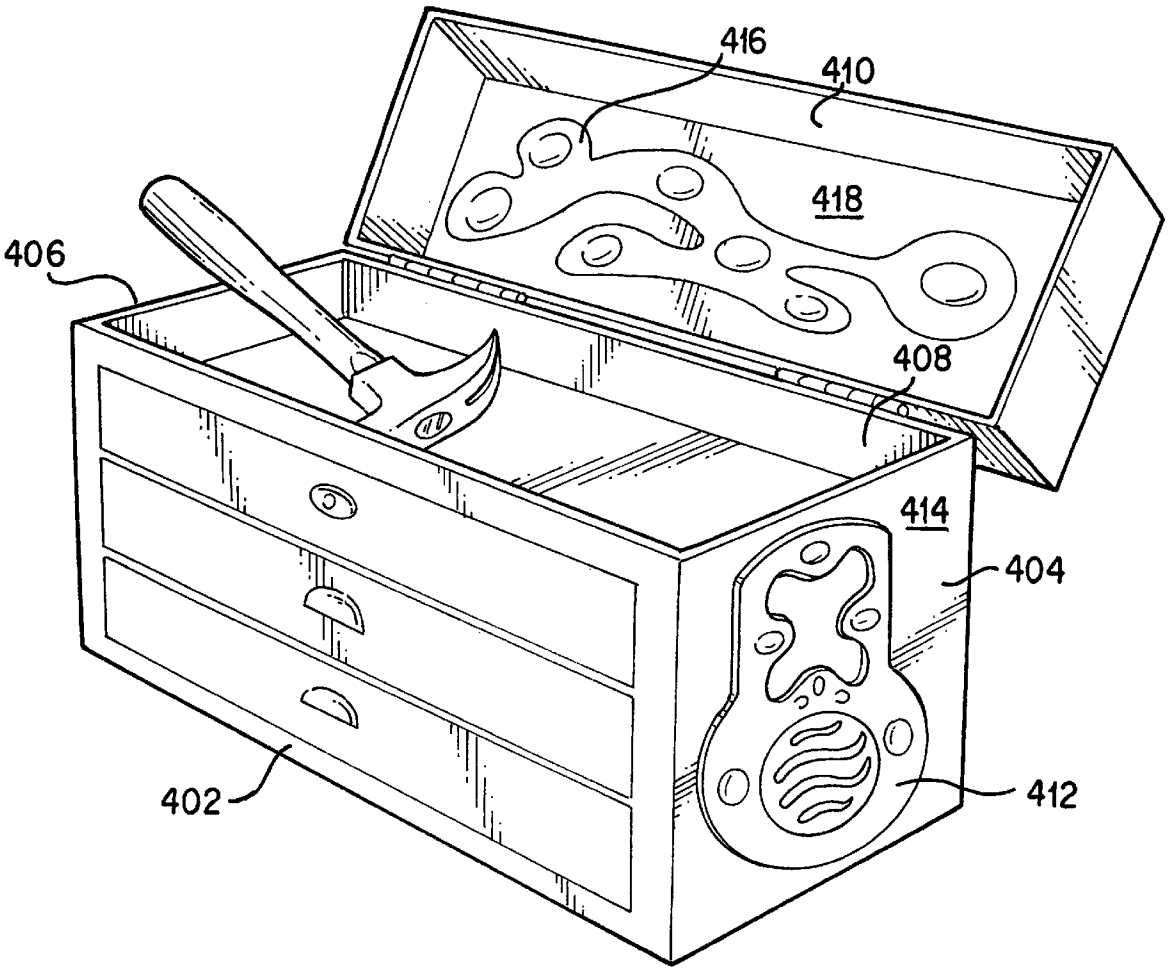

FIG. 22 illustrates a conventional tool box 400 having an interior defined by a front panel 402, side panels 404 and 406, and a rear panel 408 interconnected with each other. The tool box 400 also has a lid or cover 410 that can be hingedly coupled to the rear panel 408 for covering the open top of the tool box 400. A handle (not shown) can be provided at the top of the cover 410. A first electronic device 412 (such as a radio and/or cassette player together with a speaker) can be provided on the outer surface 414 of the side panel 404, and a second electronic device 416 (such as a plurality of touch pads coupled by an electrical path) can be provided on the bottom surface 418 of the cover 410. The electronic devices 412 and 416 can be attached to the surfaces 414 and 418, respectively, of the tool box 400 using the principles illustrated in FIGS. 4A and 4B. Here, the radio and speaker 412 can be used to provide musical entertainment to the worker during use of the tools contained in the tool box 400, while the touch pads of the second electronic device 416 can contain electronic games that provide amusement to the worker during breaks.

Figure 23:
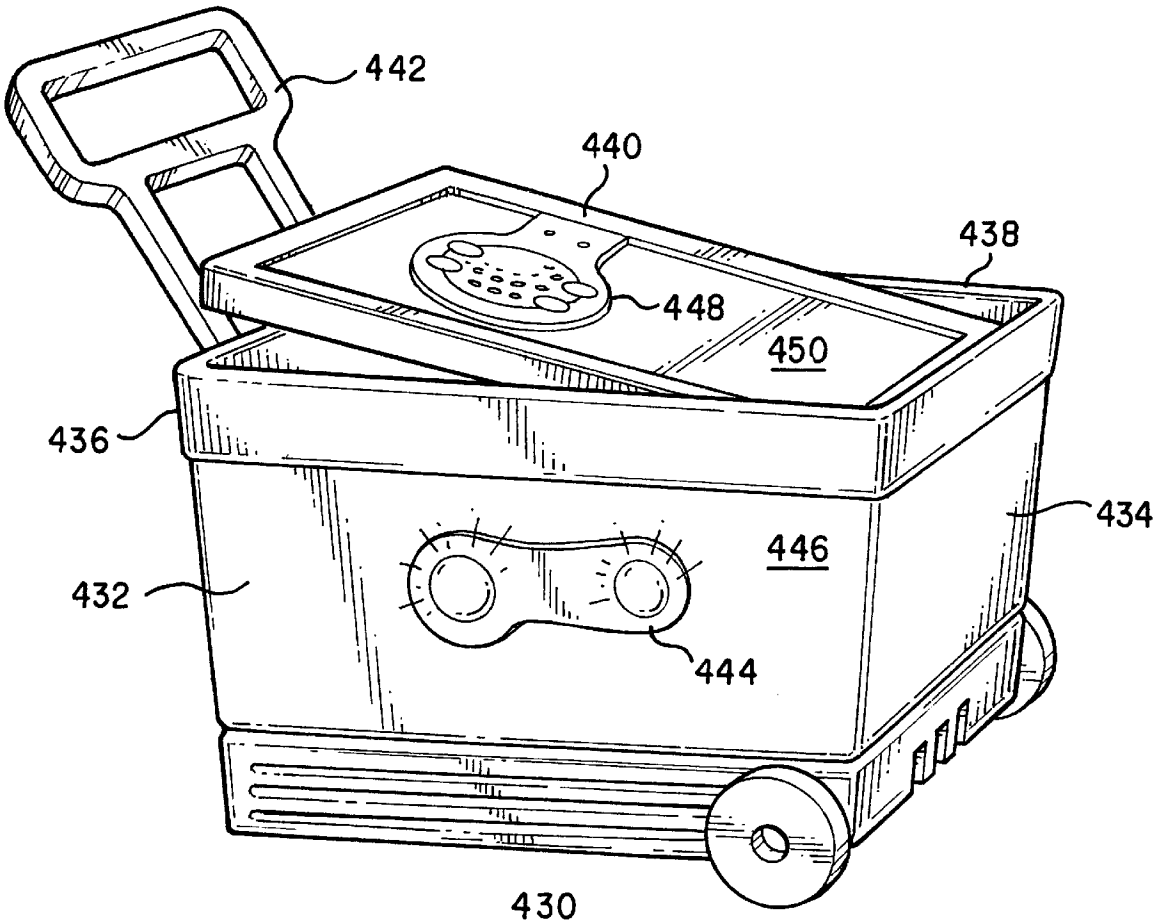

FIG. 23 illustrates a conventional beverage chest 430 having an interior defined by four side panels 432, 434, 436, 438 interconnected with each other. The beverage chest 430 also has a lid or cover 440 that can be removably coupled to the top edges of the panels 432, 434, 436, 438 for covering the open top of the beverage chest 430. A pull handle 442 can be coupled to one panel 436. A first electronic device 444 (such as blinking lights) can be provided on the outer surface 446 of a side panel 432 to provide light to the party or event at which the chest 430 is being used, and a second electronic device 448 (such as a radio and speaker) can be provided on the top surface 450 of the cover 440 to provide entertainment to the party or event at which the chest 430 is being used. The electronic devices 444 and 448 can be attached to the surfaces 446 and 450, respectively, using the principles illustrated in FIGS. 4A and 4B.

Although the FIGS. herein illustrate the amusement features as taking several specific forms, it is possible for the amusement feature to include any design, item, element or feature that promotes an activity, and can be both electronic and non-electronic. Where these amusement features are electronic in nature (such as, but not limited to, batteries, lights, antennas, screens, touch sensors, on-off pads, and speakers, among others), it is contemplated that they need to be coupled to a power source to be driven, and may need to be coupled to processors for receiving and/or transmitting control, data or other signals. These electrical components and features can be attached to the outer or inner surfaces of the carrying case by either stitching, glue or any other known connection mechanisms, in addition to the technique illustrated in FIGS. 4A and 4B. If necessary, wires can be coupled to these electrical components and power sources and processors for ensuring the transmission of power and signals therebetween. These electrical components can even communicate with a computer that can be provided with the carrying case (such as shown in FIGS. 3, 6, 7, 8, 11, 12, 13 and 16), or with a computer at a remote location and in wireless (e.g., RF) communication with an antenna that is coupled to the carrying case (e.g., as shown in FIG. 11).

Other amusement features that can be incorporated with the carrying cases of the present invention include cellular phones, microphones, musical instruments, radios, zippers, snaps, tethered balls, squeeze items, pinwheels or spinning wheels, sockets, slap items (i.e., items that emit sounds when slapped), buckles, corks, whistles, pedals, and doorbells, among others. Thus, the carrying cases according to the present invention provide the user with much added utility and educational value, in addition to an unlimited source and variety of fun and entertainment. The enhancements and features allow numerous functions, operations, and games to be utilized or played in connection with the carrying cases, and significantly extends the useful applications of the carrying cases.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A carrying case, comprising:

a storage section having at least one storage compartment for receiving articles, the storage section defining an outer panel, an opening provided in the outer panel, and a storage space inside the storage section that is accessible via the opening;

an electronic device retained in the storage space and removable from the storage space via the opening; and a slidable handle that is slidably retained inside the storage space via the opening, with the electronic device attached to the slidable handle.

2. The case of claim 1, further including locking mechanisms for retaining the electronic device inside the storage space.

3. The case of claim 1, wherein the electronic device has a housing that is hingedly coupled to a retainer piece by a hinge, with the retainer piece always disposed inside the storage space, and with the housing pivotable about the hinge to different orientations.

4. The case of claim 1, wherein the electronic device includes a plurality of electronic devices coupled to each other by electrical coupling.

* * * * *